United States Patent [19]

Campos

[11] 4,285,449

[45] Aug. 25, 1981

[54] MODULE FOR HOUSING CONTAINERS AND FOR FORMING A STORING ARRANGEMENT

[76] Inventor: Pilar A. Campos, 3435 Cabildo St., Buenos Aires, Argentina

[21] Appl. No.: 52,755

[22] Filed: Jun. 28, 1979

[51] Int. Cl.[3] ..... A47F 7/28

[52] U.S. Cl. ..... 294/32; 206/427; 211/194; 211/74

[58] Field of Search ..... 211/74, 76, 194; 206/139, 144, 427, 428, 140, 509; 224/45 A

[56] References Cited

U.S. PATENT DOCUMENTS 2,459,333 1/1949 McKinley ..... 211/74 X

FOREIGN PATENT DOCUMENTS 768097 7/1934 France ..... 211/74

6504671 10/1965 Netherlands ..... 211/74

657003 9/1951 United Kingdom ..... 211/74

*Primary Examiner*—Roy D. Frazier

*Assistant Examiner*—Robert W. Gibson, Jr.

*Attorney, Agent, or Firm*—Fleit & Jacobson

[57] ABSTRACT

A module for housing bottles and for forming a storage arrangement by stacking a plurality of said modules. Each module comprises: a base, two parallel spaced apart lateral walls and ribs connecting the lateral walls to form a bottle receiving space; notches and protrusions on one and the other sides of the module so that the notches of one module can engage the protrusion of another module to thus assure aligned stacking thereof; and a bottle retaining member rotatable between a first position permitting withdrawal of the bottles and a second position permitting withdrawal of the bottles from said bottle receiving space.

6 Claims, 5 Drawing Figures

MODULE FOR HOUSING CONTAINERS AND FOR FORMING A STORING ARRANGEMENT

BACKGROUND OF THE INVENTION

1. Field of the Invention

The present invention relates to a module or frame for housing few containers, preferably bottles, in oriented parallel array, for their sale to the public as an integral unit particularly adapted to be given as gift. The module has been conceived to also incorporate an appropriate rustic design and to be used by the purchaser to transport the bottles in vertical position and by the receiver of the gift to store the bottles in horizontal position particularly as a plurality of said modules are adapted to be stacked one above the other to form a container storage arrangement. Obviously the invention is not restricted to use by the parties as indicated above.

2. Description of the Prior Art

It is known in the art to provide wood frames in which, for exaple, three wine bottles are placed for sale; such frames being generally used as an ornamented housing for the bottles when the latter are to be used as a gift carried personally by the sender. In view of the preferred use for which these frames are designed they cannot hold more than two, three or four bottles. Additionally such frames, for aesthetic reasons, are only adapted for use in combination with bottles in a vertical position. These frames although attractive are a burden for the receiver of the gift because, if they are provided with means to avoid the bottles from accidentally falling out, they generally have to be at least partially broken to permit withdrawal of the bottles, or if they do not include such means, they are liable to let the bottles fall out, if placed, for facility of storage, in a horizontal position. Additionally, once the content of the bottle is consumed, they have to be discarded.

Frames for storing bottles in a household cellar or den are also known but they generally are designed at least for a dozen bottles because less would not be practical. Also, these frames do not store the bottles in a truly horizontal position so as to thereby avoid the bottles from falling out.

SUMMARY OF THE INVENTION

Consequently, it is the aim of the present invention to provide a module for receiving containers and preferably bottles of wine for its use as an ornamented housing for the containers and which additionally, if stacked upon one or more other modules can form a container storage arrangement for horizontally storing containers in a household cellar; the module incorporates means for preventing the containers from accidentally falling out but which permit the containers to be withdrawn when desired; the module also incorporates means to assure aligned and stable stacking of the modules. More particularly the present invention consists of a module for receiving containers, preferably bottles, in oriented parallel array, for their transport in vertical position and storage in horizontal position, a plurality of said modules being adapted to be stacked one above another to form a container storage arrangement, said module comprising;

(i) an elongated base having a longitudinal axis and a predetermined width as measured perpendicularly to said axis;

(ii) two substantially parallel, spaced apart, elongated lateral walls each having a longitudinal axis and each being secured by one end to each end of said base, said walls having like widths, as measured perpendicularly to the longitudinal axis thereof, which are the same as the width of said base, said walls being perpendicular to said base, thereby defining with said base a "U" shaped structure with a predetermined width defined by the width of said base and walls and having two parallel spaced apart imaginary sides each parallel to said axes;

(iii) first fixed container retaining means extending between said two walls and fully contained between the imaginary sides and parallel thereto and adapted to prevent movement of said containers, when positioned within the structure, perpendicularly to said longitudinal axes;

(iv) protruding means extending outwardly beyond one of the imaginary sides of said structure;

(v) notch means formed in said structure adjacent the opposite imaginary side thereof for receiving the protruding means of another module when two modules are stacked one above the other with one imaginary side of one module adjacent one imaginary side of the other module to form an arrangement having an overall width equal to the sum of the individual widths of both modules and in which the bases of said stacked modules will be coplanar, and the corresponding sides of said stacked modules are also coplanar;

(vi) and a second container retaining means also extending between said two walls and fully contained within the imaginary sides of said structure, said second container retaining means being rotatable between a first position for preventing movement of said containers, and a second position enabling movement of said containers, when positioned within the structure, parallelly to the longitudinal axes of said walls.

In order to facilitate the comprehension of the present invention, a specific embodiment will now be described, by way of example and with reference to the accompanying drawings, wherein:

Figure 1:
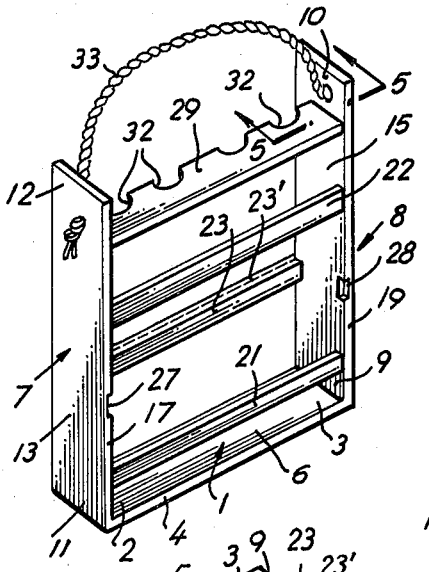
FIG. 1 is a perspective view of a module or frame of the present invention, in vertical position.

The module of the present invention comprises an elongated base 1 having a longitudinal axis (not shown) and a predetermined width as measured perpendicularly to said axis.

DETAILED DESCRIPTION OF THE PREFERRED EMBODIMENT

Base 1 has end portions 2 and 3 adjacent each end of the above mentioned longitudinal axis. Parallely to said longitudinal axis base 1 has two lateral sides 4 and 5 and two flat faces only one of which is seen at 6.

The module also comprises two substantially parallel spaced apart elongated lateral walls 7 and 8, each having a longitudinal axis (not shown), and each having ends 9, 10, 11 and 12. Lateral walls 7 and 8 are secured by their ends 9 and 11 to one end 2 and 3, respectively, of base 1.

Walls 7 and 8 also have flat faces 13, 14, 15, 16 all having like widths, as measured perpendicularly to the longitudinal axis of these walls. The widths of walls 7 and 8 are the same as the width of base 1.

Each one of walls 7 and 8 also have two lateral sides 17, 18, 19 and 20. Lateral sides 17, 4 and 19 are coplanar, thereby defining one imaginary side of the module, while lateral sides 18, 5 and 20 are also coplanar, thereby defining another imaginary side of the module, both imaginary sides being parallel to the above mentioned axes. Additionally, walls 7 and 8 are perpendicular to base 1 thereby defining a "U" shaped structure (as easily seen in FIG. 1), which has a predetermined width defined by the widths of base 1 and walls 7 and 8.

Figure 2:
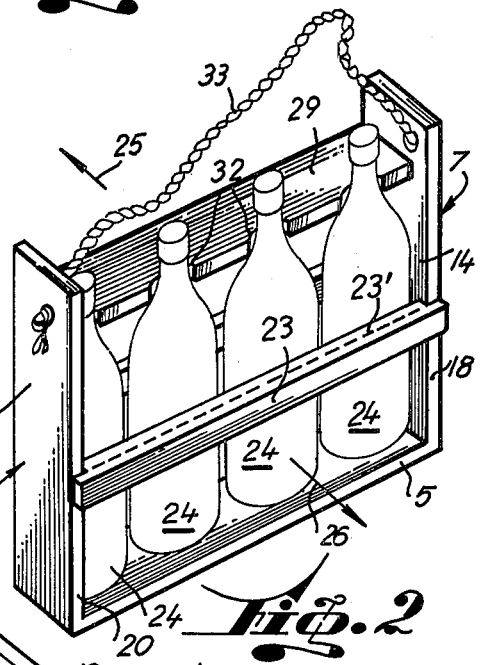
FIG. 2 is also a perspective view of the module or frame of the present invention but shown with four bottles housed therein.

The module further comprises first fixed container retaining ribs 21, 22 and 23 extending between walls 7 and 8 and fully contained between the imaginary sides defined by coplanar sides 4, 17 and 19 on one hand and sides 18, 5 and 20 on the other hand. Ribs 21, 22, 23 are parallel to these imaginary sides and they serve to prevent movement of containers 24 perpendicularly to the longitudinal axes of base 1 and walls 7 and 8, that is to say in the direction of arrows 25 and 26 in FIG. 2. Ribs 21, 22, 23 also serve to reinforce the "U" shaped structure.

The module of the present invention also comprises a protrusion defined in the embodiment shown, by an extension 23' of ribs 23 which projects outwardly beyond the imaginary side of the module defined by coplanar sides 5, 18 and 20.

Figure 3:
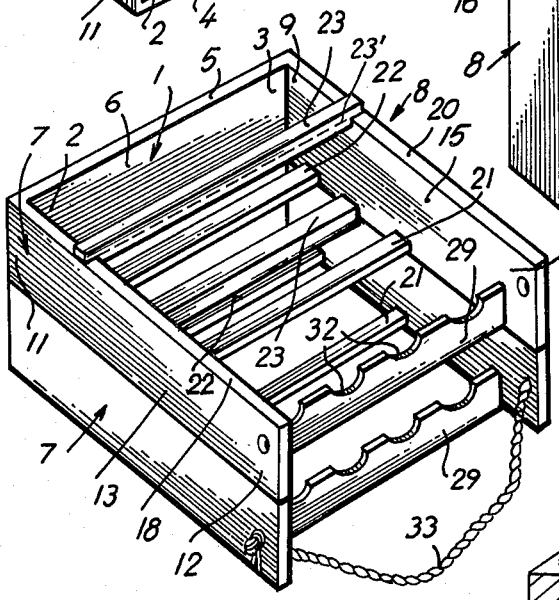
FIG. 3 is also a perspective view but of two stacked modules, each in horizontal position.
Figure 4:
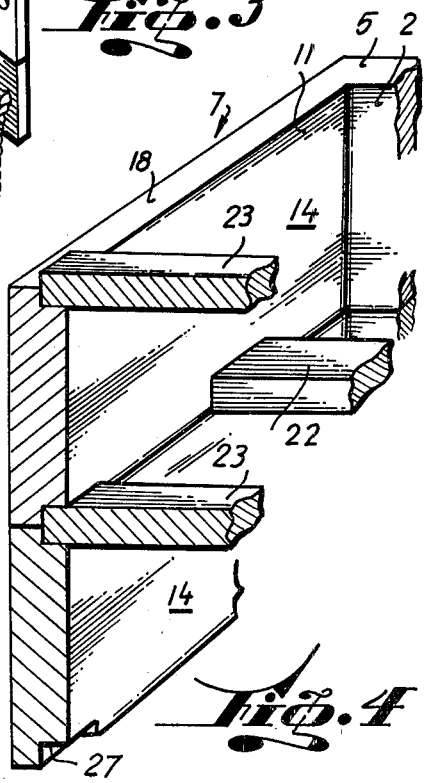
FIG. 4 is a cross-sectional view as seen along axis 4-4 of FIG. 3.
Figure 5:
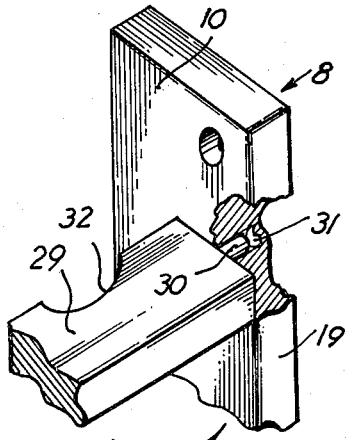
FIG. 5 is a cross sectional view as seen along axis 5-5 of FIG. 1.

Obviously this protrusion 23' instead of being a uniform strip integral with rib 23, can consist of a supplementary strip of material adhered to rib 23 or any other appropriate protruding means adapted to be received within notches 27, 28 formed adjacent the opposite imaginary side of the frame, in walls 7 and 8. The dotted lines separating rib 23 from protrusion 23' have only been incorporated in the drawing so as to illustrate the possibility that the rib 23 and protrusion 23' can be either formed from a single piece of material such as wood or plastic or that they can be different bodies adhered together for use in the frame of the present invention. It will be evident to those skilled in the art that protrusion 23' does not have to be a continuous member extending all along rib 23; it is sufficient to provide two small protruding strips, one at each end of rib 23 so that each one of these strips engages one of notches 27 and 28. Other shapes for protrusion 23' and notches 27 and 28 can also be provided as long as they permit fulfilment of the stacking of the modules. When two modules are stacked (as shown in FIG. 3) one above the other, with one imaginary side (defined by sides 17, 4 and 19) of one module substantially coincident with one side (defined by sides 18, 5 and 20) of another module, an arrangement is formed in which all the bases of the stacked modules are coplanar while all walls 7 are in one plane and all walls 8 of the modules are in another plane, this obviously is achieved by correctly placing, in corresponding positions protrusions and notches 27, 28.

The module of the present invention also comprises second container retaining means consisting of a flat, elongated board or plate-like member 29 having a peg 30 at each end thereof. Each one of pegs 30 is rotatably received within a perforation 31 defined in each one of ends 10 and 12 of lateral walls 7 and 8. For aesthetic reasons perforations 31 do not preferably extend through lateral walls 7 and 8.

Due to its rotatable mounting, plate-like member 29 can be positioned in any of a multiplicity of positions although in essence plate-like member 29 will be adapted to adopt one of two operative positions: a first position for preventing movement of the bottles and a second position enabling movement of the bottles, both parallelly to the longitudinal axes of lateral walls 7 and 8. Obviously this movement is the one needed to withdraw bottles 24 from the module.

In the first position, the plane containing plate-like member 29 is perpendicular to the longitudinal axes of lateral walls 7 and 8 (position shown in FIG. 1). In this position, plate-like member 29, due also to grooves 32, defined along one flat edge thereof, will prevent bottles 24 from falling out of the module, if tilted or if placed in a horizontal position as shown in FIG. 3. Grooves 32 also serve as a resting surface for the neck of bottles 24 when the frame and bottles are in a horizontal position. If it is desired to withdraw a bottle from the module, it is simply sufficient to rotate 90°, withdraw the bottle and then rotate plate-like member 29 back to the position shown in any of FIGS. 1 to 3.

Plate-like member 29 is dimensioned so as to extend between lateral walls 7 and 8 and be fully contained within the two imaginary sides, as described above, of the module so as to not interfere with stacking of the modules.

A handle 33 is provided extending between the ends 10 and 12 of walls 7 and 8 for transporting the frame and bottles.

Those skilled in this art may introduce certain minor changes into the embodiment described and illustrated. However, such changes and modifications will be comprised within the true spirit and scope of the invention which are defined in the claims.

I claim:

1. A module for receiving containers, preferably bottles, in oriented parallel array, for their transport in vertical position and storage in horizontal position, a plurality of said modules being adapted to be stacked one above another to form a container storage arrangement, said module comprising:

(i) an elongated base having a longitudinal axis and a predetermined width as measured perpendicularly to said axis;

(ii) two substantially parallel, spaced apart, elongated lateral walls each having a longitudinal axis and each being secured by one end to each end of said base, said walls having like widths, as measured perpendicularly to the longitudinal axis thereof, which are the same as the width of said base, said walls being perpendicular to said base, thereby defining with said base a "U" shaped structure with a predetermined width defined by the width of said base and walls and having two parallel spaced apart limaginary sides each parallel to said axes;

(iii) first fixed container retaining means extending between said two walls and fully contained between the imaginary sides and parallel thereto and adapted to prevent movement of said containers, when positioned within the structure, perpendicularly to said longitudinal axes;

(iv) protruding means extending outwardly beyond one of the imaginary sides of said structure;

(v) notch means formed in said structure adjacent the imaginary side thereof opposite said protruding means for receiving the protruding means of another module when two modules are stacked one above the other with one imaginary side of one module adjacent one imaginary side of the other module to form an arrangement having an overall width equal to the sum of the individual widths of both modules and in which the bases of said stacked modules will be coplanar, and the corresponding sides of said stacked modules are also coplanar;

(vi) and a second container retaining means also extending between said two walls and fully contained within the imaginary sides of said structure, said second container retaining means being rotatable between a first position for preventing movement of said containers, and a second position enabling movement of said containers, when positioned within the structure, parallel to the longitudinal axes of said walls.

2. A module as claimed in claim 1, further comprising handle means extending between the ends of said walls which are remote from the ends of said walls which are secured to said base.

3. A module as claimed in claim 1, wherein said first retaining means are ribs positioned adjacent each side of the structure.

4. A module as claimed in claim 3, wherein said protruding means is defined by one of said ribs which also extends outwardly from one of the sides of said structure.

5. A module as claimed in claim 4, wherein said notch means are notches defined in said lateral walls.

6. A module as claimed in claim 1, wherein said second retaining means is an elongated plate member pivoted at its ends to said walls to rotate in a plane parallel thereto between said first and second positions, said plate member having container retaining grooves along one edge thereof for receiving and retaining said containers when said elongaged plate member is in said first position.

* * * * *